US009241877B2

(12) United States Patent
Burton et al.

(10) Patent No.: US 9,241,877 B2
(45) Date of Patent: Jan. 26, 2016

(54) PILL COUNTING TRAY WITH DIGITAL COUNTER

(71) Applicant: Evolving Innovations, Inc., Morehead, KY (US)

(72) Inventors: Byron Scott Burton, Morehead, KY (US); Mike Potter, Mount Sterling, KY (US); Guy Marsden, Wollwich, ME (US)

( * ) Notice: Subject to any disclaimer, the term of this patent is extended or adjusted under 35 U.S.C. 154(b) by 289 days.

(21) Appl. No.: 14/036,261

(22) Filed: Sep. 25, 2013

(65) Prior Publication Data

US 2014/0093344 A1 Apr. 3, 2014

Related U.S. Application Data

(60) Provisional application No. 61/706,814, filed on Sep. 28, 2012.

(51) Int. Cl.
*A61J 7/02* (2006.01)

(52) U.S. Cl.
CPC ..... *A61J 7/02* (2013.01)

(58) Field of Classification Search
CPC ..... A61J 7/02
USPC ..... 414/675, 901; 222/462, 572, 557
See application file for complete search history.

(56) References Cited

U.S. PATENT DOCUMENTS

| | | | | |
|---|---|---|---|---|
| 2,530,009 | A * | 11/1950 | Fields | A61J 7/02 222/129 |
| 2,812,784 | A | 11/1957 | Palmer | |
| 3,255,894 | A | 6/1966 | Van Handel et al. | |
| 3,900,718 | A * | 8/1975 | Seward | G06M 7/00 235/98 C |
| 4,065,000 | A | 12/1977 | Murton | |
| 4,213,730 | A | 7/1980 | Di Gaetano | |
| 4,261,683 | A | 4/1981 | Zaleon | |
| 4,396,828 | A * | 8/1983 | Dino | G06M 1/101 221/7 |
| 4,597,091 | A | 6/1986 | Blake | |
| D298,968 | S | 12/1988 | McAllister | |
| 4,901,865 | A | 2/1990 | Staples | |
| 5,092,471 | A | 3/1992 | Pinizzotto et al. | |
| 6,053,302 | A * | 4/2000 | Leu | A61J 7/02 198/471.1 |
| 6,196,426 | B1 * | 3/2001 | White | A61J 7/02 222/462 |
| 6,574,580 | B2 * | 6/2003 | Hamilton | A61J 7/02 137/2 |
| 6,821,079 | B2 | 11/2004 | Priebe et al. | |
| 8,118,944 | B2 | 2/2012 | Fay et al. | |
| 2003/0165377 | A1 * | 9/2003 | Priebe | A61J 7/02 414/675 |
| 2007/0112692 | A1 * | 5/2007 | Bolduc | G06F 3/03545 705/400 |
| 2009/0285663 | A1 | 11/2009 | Chemel | |

* cited by examiner

*Primary Examiner* — Saul Rodriguez
*Assistant Examiner* — Lynn Schwenning
(74) *Attorney, Agent, or Firm* — Michael Coblenz

(57) ABSTRACT

A pill counting tray for counting pills. The pill counting tray includes a digital counter with a sensor that can digitally count the pills as they are being moved by a wand on the tray. The pill counting tray also includes a number of small evenly spaced terrain domes on one part of the tray to prevent the pills from clumping or clustering. The pill counting tray also includes a hinged return funnel that inclines upward when the pill counting tray is placed on a counter during counting, such that the hinged funnel creates a backstop to prevent pills from rolling off of the tray. The hinged funnel will rotate downward when the pill counting tray is lifted to ease the return of excess pills to the stock bottle. A portion of the surface of the hinged funnel also includes a number of spaced terrain domes.

16 Claims, 9 Drawing Sheets

PILL COUNTING TRAY WITH DIGITAL COUNTER

CROSS REFERENCE TO RELATED APPLICATIONS

This application is a continuation in part of U.S. provisional application 61/706,814, filed on Sep. 28, 2013, and incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to a tray for counting pills or other medication, and more particularly to a modified pill counting tray with means for preventing pill clumping, a means for ease of excess pill return, and a digital pill counter to help prevent miss-counts, and to ensure accurate pill counting and dispensing.

2. Description of the Related Art

Pill counting trays are standard equipment in pharmacies and pharmacists' offices. Pharmacists received medication in pill form from medical suppliers in large stock bottles containing hundreds or thousands of pills, and dispense medicine to patients in smaller pill bottles containing a smaller amount of pills as prescribed by the patient's doctor. Typically pills are dispensed to patients in a limited supply, often a one month supply, or for medication like antibiotics, in an amount based on the required course of the medication. It is increasingly common for doctors and other prescribers to provide the patient with a three month supply of medication. Common prescription quantities, therefore, are 30, 60, 90, 120, 150, 180, 210, 240, 270, 360, 540. The pharmacist uses the pill counting tray to transfer the pills from the stock bottle to the patient's pill bottle. The counting of pills on a pill counting tray by a human pharmacist or technician is the most common method for counting pills worldwide. It is likely that every pharmacy in the world uses standard pill counting trays, and likely puts them to use many times during the day to distribute prescribed medicine.

Pill counting trays have been around for years. One of the earliest patents for a pill counting tray was U.S. Pat. No. 2,530,009 to Fields, and issued on Nov. 14, 1950. Standard pill counting trays are still very similar to the Fields invention, and have three major components. The first is a flat pill counting surface, which is in the middle of the tray. On one side of the counting surface is a dispensing chamber, and on the other side of the surface is a return spout. Pills are poured onto the counting surface from the stock bottle. The pharmacist, or pharmacist's technician, pours out what he or she believes is roughly the correct amount of pills, or typically a few more than the correct amount. Then the pharmacist counts the required number of pills into the dispensing chamber. As used herein, the term "count" is used as a verb and refers to the physical sliding of a defined number of pills with the wand from the counting tray to the dispensing chamber. The pharmacist uses a flat tool that looks like a butter knife or small putty knife with a rounded end, and which is called a wand, a spatula, or a counting stick. The term wand will be used herein. The dispensing chamber is half tube with a cover, and often a funnel at the end. Once the correct number of pills are counted into the dispensing chamber, the cover is closed to prevent the pills from spilling. There will be a number of excess pills still on the counting surface. These pills can be poured back into the stock bottle by means of the return spout.

There are a number of problems associated with the standard pill counting tray. Typically the pharmacist pours the pills out of the stock bottle near the return spout. This is to prevent pills from inadvertently going into the dispensing chamber. Unfortunately this means that pills commonly collect and often bunch up or layer one on top of another. Large tablet pills and nearly all capsules clump together and exhibit layering. This makes accurate counting difficult until you evenly spread the pills out into a single layer, which can delay the start of a technician's count and increase the patient's wait time for the medication. There is a need, therefore, for a means for preventing pill clustering and clumping.

Another common problem that occurs is when pouring excess pills back into the stock bottle, they tend to flow out all at once. During the return pour, the fast-flowing pills quickly overwhelm the tiny return spout. This causes the pills to spill onto the countertop and/or floor, and the medication becomes contaminated. Employees touching the pills add to further medication contamination. All this also slows down the dispensing of medicine to the patient, and increases the likelihood that the medication they receive is unsanitary. There is a need, therefore, for an improved return spout to ensure the proper return of pills to the stock bottle.

Another common problem occurs when pouring pills from the stock bottle onto the standard counting trays. If too many pills are poured, or are poured too quickly, it is common for the pills to quickly fill up the available space on the counting surface and run out the return spout and onto the countertop or on to the floor, causing contamination of the medicine. This situation occurs frequently in every pharmacy, especially with newly hired employees. This type of error is not only unsanitary, but it also slows down dispensing time as employees have to address and rectify the spill. This also adds to the cost to the pharmacy as damaged and contaminated pills are discarded. There is a need, therefore, for an improved return spout that prevents the spilling of excess pills.

Another problem is that when returning pills in current model counting trays to the stock bottle, tilting the tray too rapidly or at too steep of an angle will result in some or all of the pills spilling out of the return spout. Or, if the pills are poured too slowly, they will clump and block the return spout. This is because the standard return spout is not made for high volume pill flow. There is a need, therefore, for an improved return spout.

There are two common problems encountered with counting the pills on the standard pill tray. The first is that it is easy to lose count. Technicians waste time and decrease business productivity when they have to recount pill quantities. This can be caused by self-inflicted distractions or thoughts, answering a phone call, addressing a fellow colleague, taking a prescription from a patient at the front counter, or having to disperse clumping pills. These distractions can cause the technician to loose count, and to have to return pills to the counting surface and resume the count. This problem is exacerbated by the fact that it is increasingly common to prescribe some pills in large quantities, some times over 500 pills to a bottle. This makes counting more difficult. Another problem, though less common, is that manual counting can allow someone in the pharmacy to steal medication. Since the count into the patient's pill bottle is only as good as the person doing the counting, and since pills returned to the stock bottle are not precisely or accurately counted, it means that it is easy for a few pills to essentially slip through the cracks. In some instances (particularly with valuable narcotics) these pills can be stolen by unscrupulous employees. A means for accurately counting pills will minimize the possibility of miscounting.

The current system is inefficient and these flaws should be addressed. There are a couple of alternatives currently presented by the market. Dispensing medication from the factory in pre-packaged bottles is one alternative. In this system the correct number of pills are inserted into the medicine bottle at the pill manufacturing facility. However this method has numerous issues and potential risks. The most common drugs come in large 500 or 1,000 count stock bottles, but sometimes they come in 30 and 90 count pill bottles which are ready to be dispensed to patients. Unfortunately it is not uncommon that stock bottles are sealed and shipped with fewer pills than the advertised bottle quantity, which can leave both the pharmacy and patient short on medicine. Stock bottles also commonly contain either crushed or broken pills, because no employees have verified the contents of the bottle before it is shipped. Also it is common for a desiccant, which is used as a preservative and to absorb moisture, to be present in the stock bottle, and it is not uncommon for a desiccant to be inadvertently placed in the prescription sized bottles. The desiccant is a dangerous choking hazards for children and elderly dementia patients once the bottle has been opened. Numerous studies have been reported of dementia patients taking desiccants thinking that they were pills. This type of ingestion can cause severe poisoning. It's clear that the risks and disadvantages associated with dispensing stock bottles outweigh any potential benefits.

There are a number of methods currently available to machine count pills during the dispensing process. The two most common options are weight and laser based counting machines. The weight based machines count by weight, and do not distinguish between a whole or broken pills. There is a similar problem with the laser counters. This significantly degrades the efficiency of machine counting methods. The other problem associated with machine counters is the cost. A standard pill counting tray costs about $20 while a simple laser counter or weight counter costs roughly $1,500 and often more, and more advanced high tech machines can cost upwards of $250,000. Because of the cost and other problems noted, the preferred solution is human counting. It delivers accuracy, safety, and does not require moderate to high expenditures on machinery, service contracts, and scheduled maintenance. There is a need, therefore, for a method of counting pills that incorporates the benefits of human pill counting with the advantages of machine counting.

SUMMARY OF THE INVENTION

The present invention is a modified pill counting tray with a digital counter, a means for preventing pill clustering, and an improved pill return system. The present invention includes small bumps on the tray surface, referred to herein as "terrain domes," that deter the clumping of pills. The terrain domes are sized, spaced, and configured to prevent pills from clumping, clustering, piling on one another, which frequently slows the pill count. The present invention includes an incline-decline hinged funnel stock return, which minimizes countertop spills and facilitates the ergonomic return of unused pills to the stock bottle. When placed on a countertop for a pill count, the incline-decline hinged funnel is rotated upward to create a back-stop that will prevent pills from flowing off the counting tray through the return spout. The surface of the hinged funnel also includes terrain domes.

The present invention further includes a programmable digital counting system to ensure an accurate count and faster dispensing of the pills. The digital counting system incorporates a counting wand and a sensor designed to sense the movement of the counting wand to automatically count the number of wand swipes as the user swipes pills from the counting tray into a dispensing chamber. The counting system is programmable to allow the user to count multiple pills per swipe. The counting system further includes a visible display to show the number of swipes, the number of pills counted per swipe, and the running total of the pill count. In an alternate embodiment the display can incorporate an audible sound or beep to note the number of swipes.

DETAILED DESCRIPTION OF THE INVENTION

Detailed embodiments of the present invention are disclosed herein. It is to be understood, however, that the disclosed embodiments are merely exemplary of the invention and that the invention may be embodied in various and alternative forms. Therefore, specified structural and functional details disclosed herein are not to be interpreted as limitations, but merely as a basis for the claims and as a representative basis for teaching one skilled in the art to variously employ the present invention.

Figure 1:
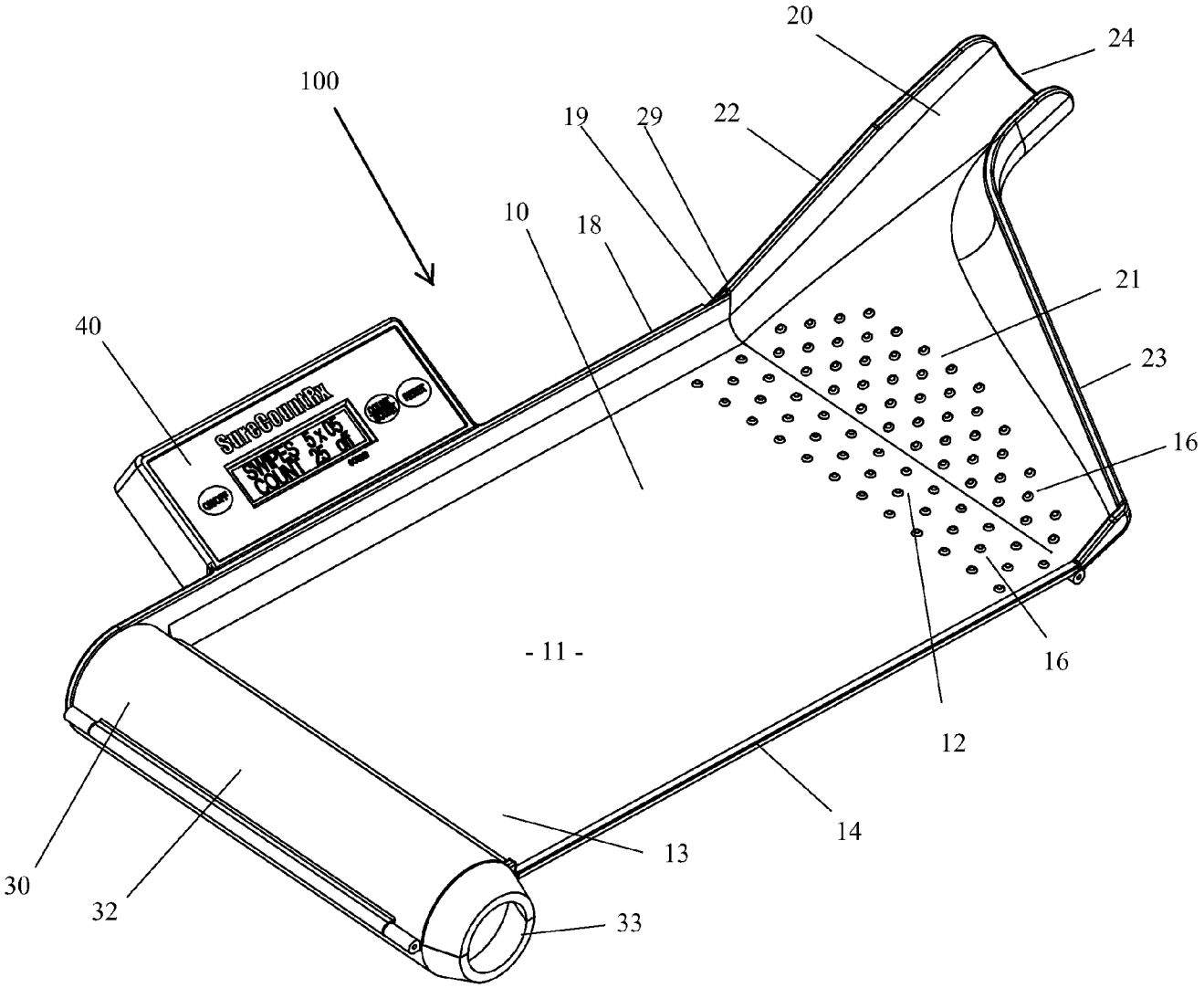
FIG. 1 is a perspective view of the invention showing the main components.
Figure 2:
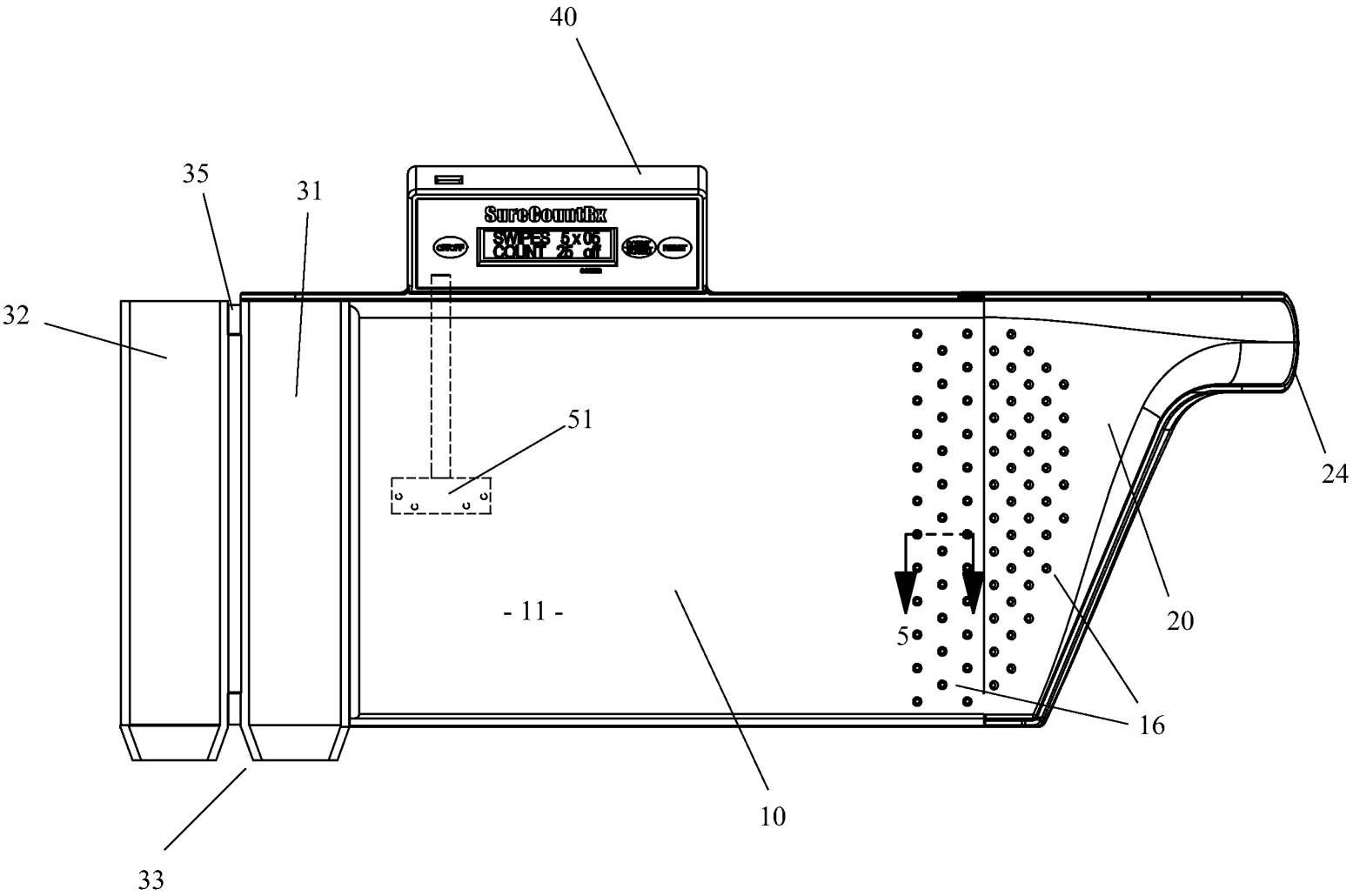
FIG. 2 is a top plan view of the invention showing the main components.
Figure 3:
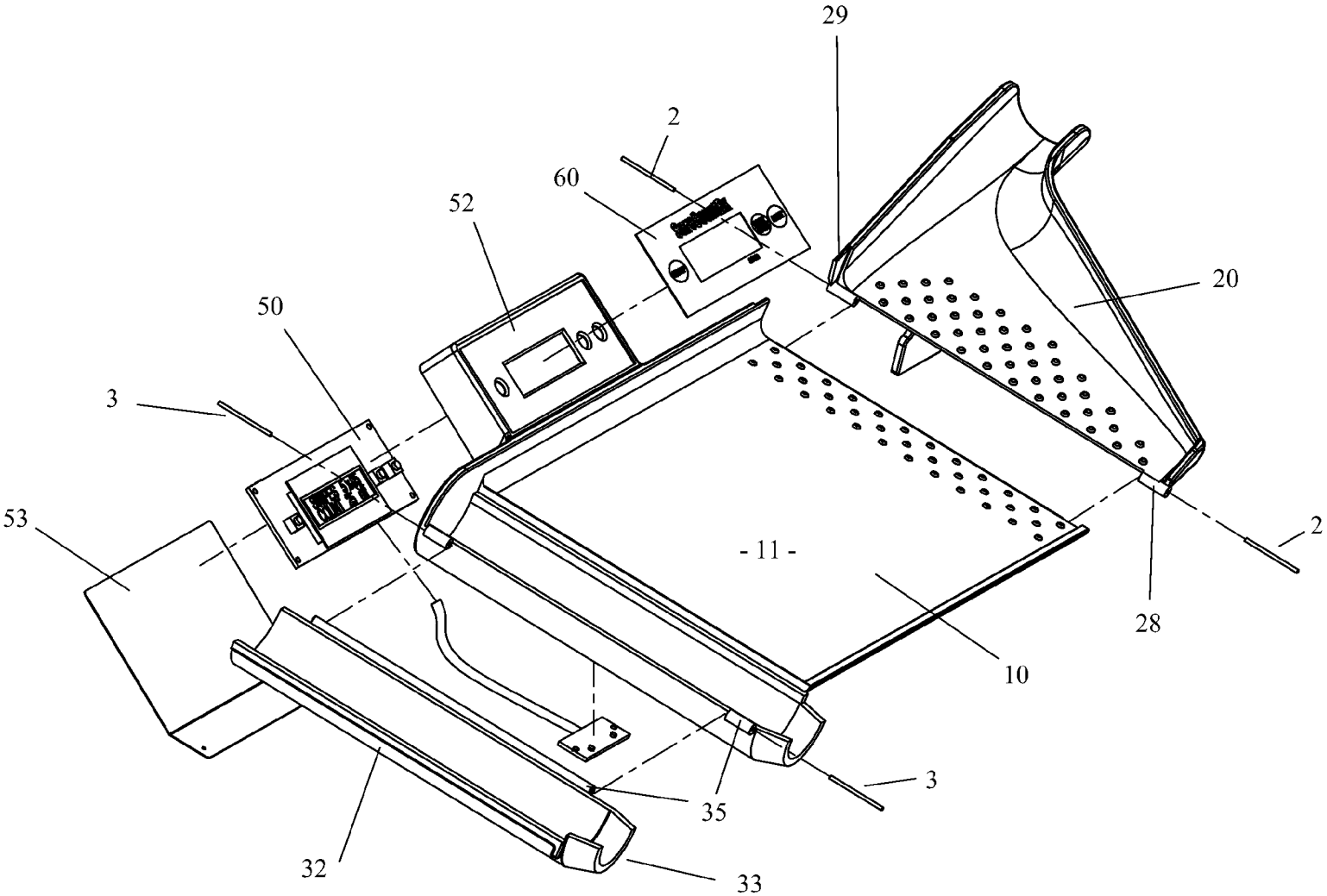
FIG. 3 is an exploded top view of the invention showing the main components.
Figure 4:
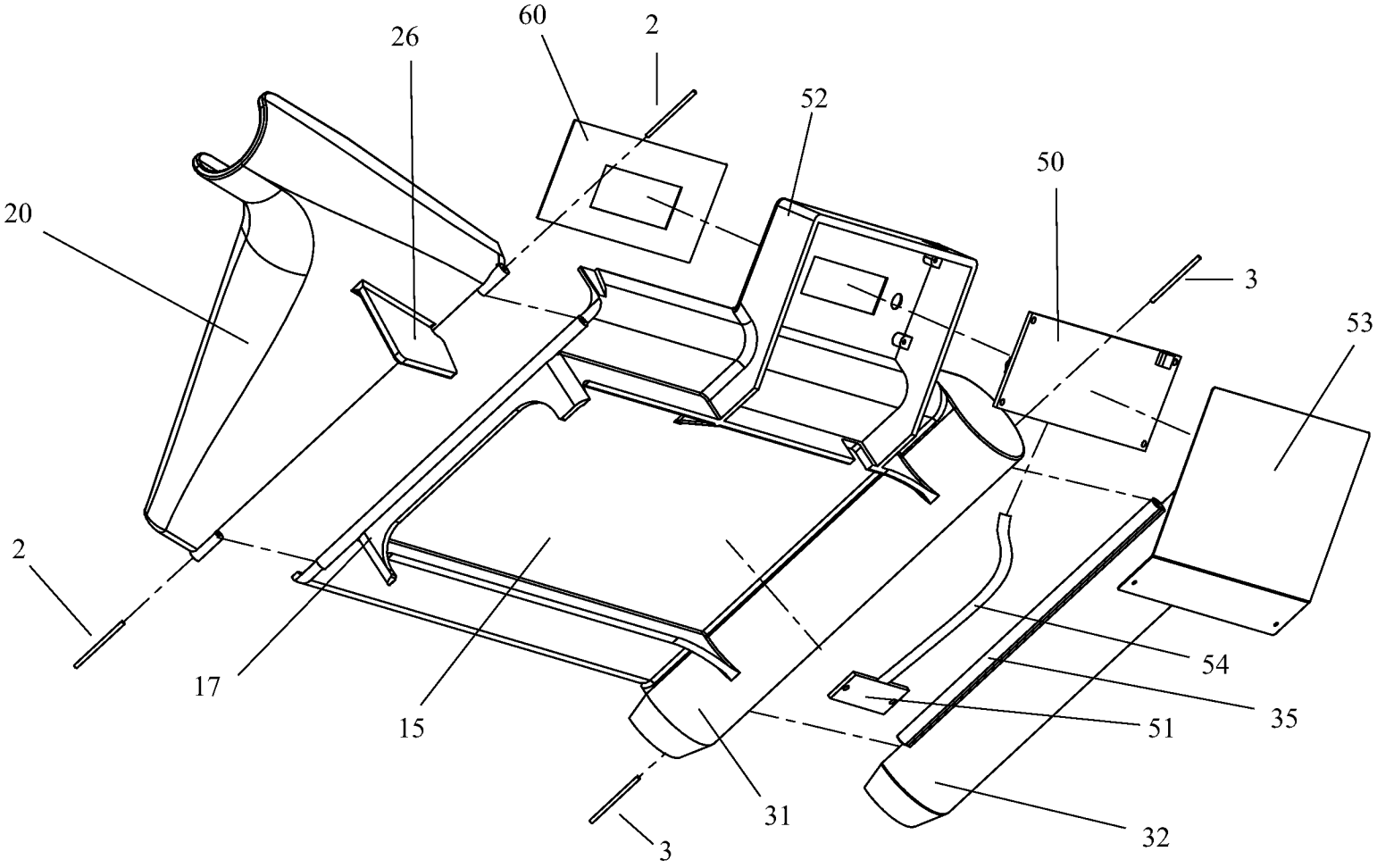
FIG. 4 is an exploded bottom view of the invention showing the main components.

FIG. 1 is a perspective view, FIG. 2 is a top plan view, FIG. 3 is an exploded view of the top, and FIG. 4 is an exploded view of the bottom, all showing the main components of the invention. The pill counting tray 100 consists of a counting tray 10, an included hinge funnel 20, which is attached to the right side of the counting tray 10, a dispensing chamber 30, which is attached to the left side of the counting tray 10, and a Programmable Digital Counting System (PDCS) 40, which is located on the back side of the counting tray 10. The counting tray 10 is a flat surface that is generally rectangular in shape. It has a counting surface 11 on which pills P are disposed for counting. It has a return side 12, which is on the right hand side located near the connection to the incline/decline hinged funnel 20. It also has a dispensing side 13, which is located on the left near the dispensing chamber 30. It also has a front edge 14 and a rear wall 18. The front edge 14 is flat with the counting surface 11, which allows the pharmacist or technician (the words are used interchangeably throughout to describe the person counting pills P on the tray 100) to count pills P on the counting surface 11 by means of a wand 70. The counting tray 10 also has a counting tray underside 15.

In the preferred embodiment the counting tray 10 is a rectangle 6½ inches deep from the front edge 14 to the rear wall 18, and 9½ inches wide from the edge on the dispensing side 13 to the edge on the return side 12. The rear wall is ½ inches tall. The purpose of the rear wall 18 is to prevent the pills P from sliding off the back portion of the counting surface 11. The counting tray 10 can come in many different sizes depending upon the needs of the users, but will generally be roughly 6 to 12 inches wide and roughly 4 to 10 inches deep. It is to be understood that the configuration with the hinged funnel 20 on the right, and the dispensing chamber 30 on the left is the most common, since it is designed for right handed technicians, but it is possible, and within the conception of the invention, for the pill counting tray 100 to be a mirror image, with the dispensing chamber 30 on the right, and the incline/decline hinged funnel 20 on the left. In the preferred embodiment the components of the pill counting tray 100 (except the digital counter) are made from molded plastic of a type well known in the art. Such molding is well known, and all of the components can easily be molded into the appropriate geometric configurations.

Figure 5:
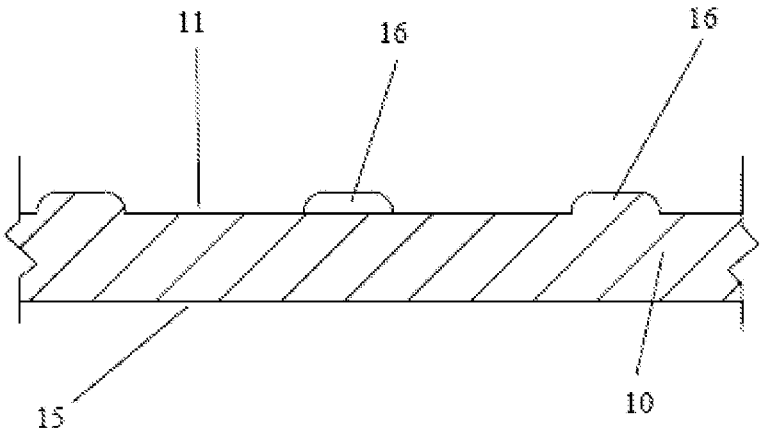
FIG. 5 is a cross section of the tray counting surface showing the terrain domes.
Figure 6:
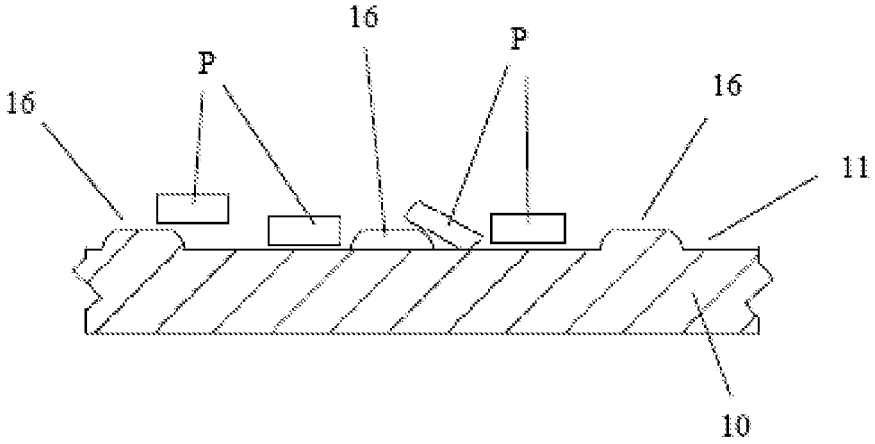
FIG. 6 is a cross section of the counting surface with pills on the terrain domes.

There are a number of small semi-spherical bumps, defined herein as terrain domes 16, disposed on the counting surface 11 of the return side 12 of the counting tray 10. Terrain domes 16 are numerous tiny bumps that populate the return side 12 and part of the hinged funnel 20, as shown in detail in FIG. 7 and FIG. 8. In one embodiment the terrain domes 16 are semi-spherical bumps approximately 0.03 inches high, and 0.13 inches in diameter. In the preferred embodiment, shown in the cross section view FIG. 5, the terrain domes 16 are cylindrical as the rise from the counting surface 11, with the tops having a slightly rounded edge, having a radius of 0.03 inches. The terrain domes 16 are sized to prevent the clumping of pills P when placed on the surface 11 of the counting tray 10. As shown in FIG. 6, the size of the terrain domes 16 in the preferred embodiment is optimal to slightly raise the pills P off the surface 11 to prevent clumping, but not so big as to allow the pills P to flip over or become unstable. It is possible for the terrain domes 16 to range in height from 0.01 inches 0.10 inches, and possible to range in diameter from 0.05 inches to 0.20 inches. In the preferred embodiment the terrain domes 16 are, as the name implies, roughly dome shaped, or a portion of a sphere. But it is possible for the terrain domes 16 to be button shaped, or cylindrical. It is also possible for the terrain domes 16 be square of any other geometric shape.

Figure 8:
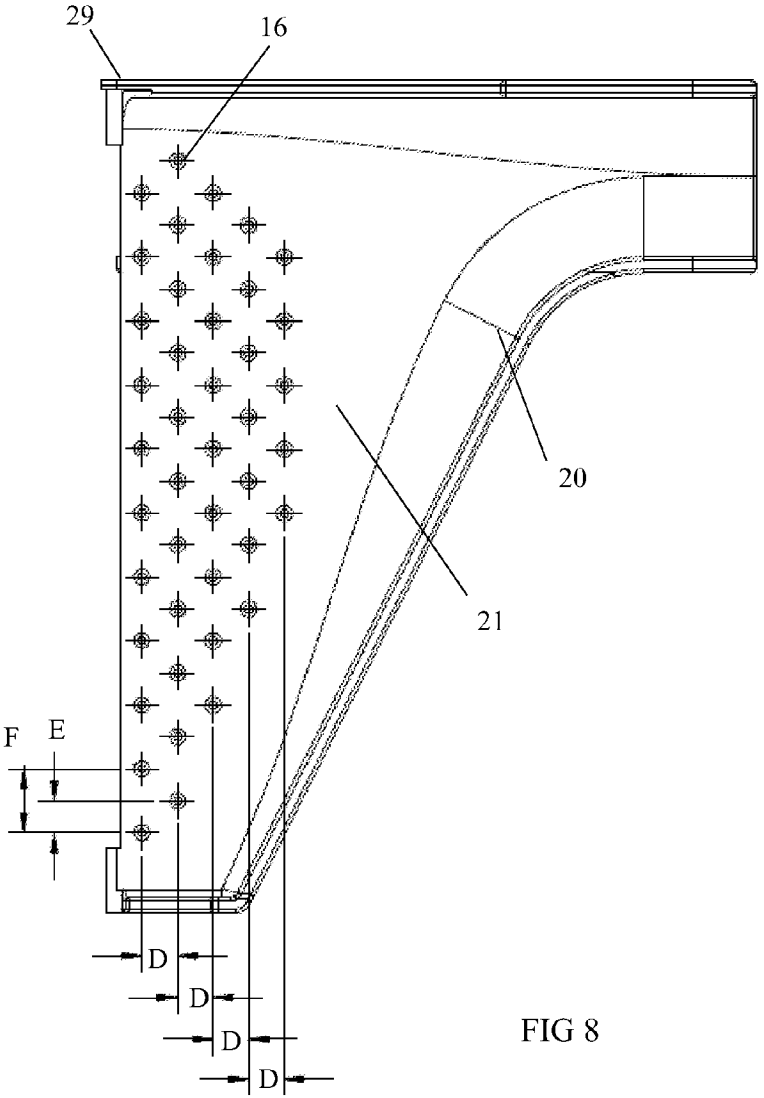
FIG. 8 is a top plan view of the hinged funnel showing the configuration of the terrain domes on the funnel.
Figure 7:
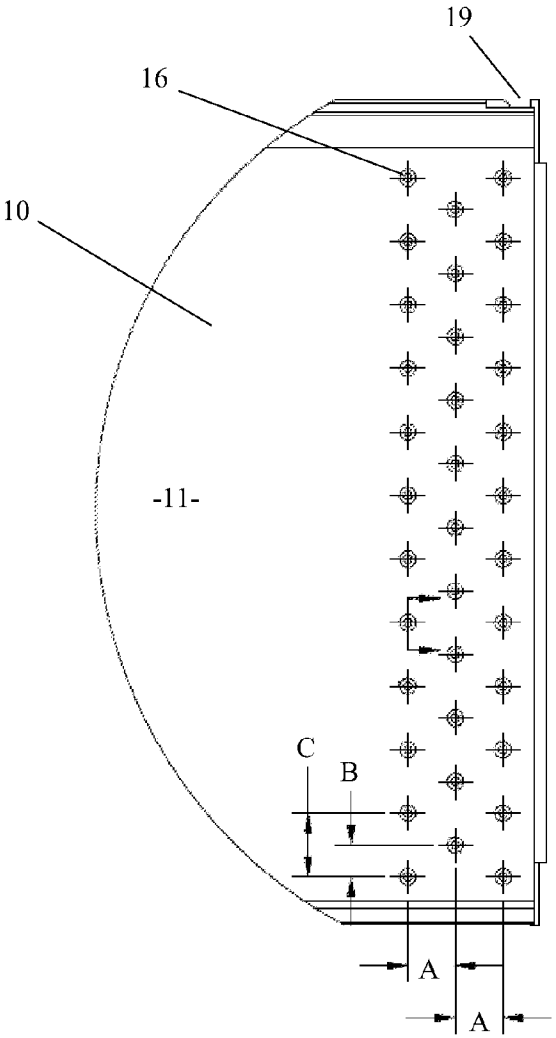
FIG. 7 is a top plan view of part of the counting tray showing the configuration of the terrain domes on the counting tray.

The terrain domes 16 are spaced in an even patterned grid, as shown in FIG. 7 and FIG. 8. In the preferred embodiment the terrain domes 16 of the counting tray 10 occupy roughly the first inch of the return side 12 of the counting tray 10. The terrain domes 16 left to right line spacing A is 0.38 inches apart, and front to back dome spacing B is 0.25 inches apart. It is understood that the actual spacing can vary. This spacing allows some pills P to be raised, while other pills P on the counting surface 11 between the terrain domes 16 will lay flat on the surface 11. This mix of raised and flat pills P is a key component to prevent the pills from clumping. The terrain domes 16 aid in creating a single layer of pills P on the counting surface 11, which will expedite the counting process since the technician does not have to uncluster pills P before beginning the counting process. This speeds up the counting and dispensing process. The main purpose of the terrain domes 16 on the counting tray 10 is to de-layer pills P when pouring from the stock bottle to the counting surface 11. In the preferred embodiment the terrain domes 16 are located on the return side 12 of the counting tray 10, and occupy the far right inch or so of the counting surface 11, but it is possible for the terrain domes 16 to be present to nearly the middle of the counting tray 10, or even further toward the dispensing end 13. It is preferable for the counting tray 100 main counting surface 11 of the counting tray 10 to be flat and smooth, since this will facilitate the sorting and counting of pills P with the wand 70, it is possible to have terrain domes 16 on the entire surface 11.

The incline-decline hinged funnel 20 is designed to facilitate the return of excess pills P to the supply stock bottle, and to prevent the flow of uncounted pills P off of the counting surface 11. The hinged funnel has a funnel surface 21, a top wall 22, a side wall 23, a spout 24, a hinged funnel underside 25 and a funnel pedestal 26 attached to the hinged funnel underside 25. The top wall 22 and side wall 23 are raised to prevent the pills from spilling, and are angled together to form the spout 24, which allows the excess pills P to be easily poured back into the stock bottle. In the preferred embodiment the hinged funnel is 6½ inches deep from the front to the top wall 22. The hinged funnel is angled, and the width varies from roughly 1 inch where the side wall 23 connects to the counting tray 10, to roughly 4 inches wide near the spout 24. The side wall 23 is angled from near the front edge 14 of the counting tray 10 and angles away to create a pouring funnel that terminates in the spout 24. The side wall 23 is included upward from level with the counting surface 10 at the front edge 14, to approximately one inch in height at the spout 24. The top wall 22 is similarly inclined upward from level with the top of the rear wall 18 to approximately one inch at the spout 24. The top wall 22 and side wall 23 are relatively high in relation to the hinged funnel 20, and they converge to create a high spout 24 that minimizes the likelihood that pills will overflow the funnel 20 and spill onto the counter and/or floor. The top wall 22 touches the rear wall 18, and runs in a straight line with the rear wall 18. This configuration assists in pouring the excess pills off of the counting tray 10, onto the hinged funnel 20, through the spout 24 and into the stock bottle.

There are a number of terrain domes 16 disposed on the funnel surface 21 near where the hinged funnel 20 is attached to the counting tray 10. The terrain domes 16 located on the funnel surface 21 help direct the pills to the spout 24 in a controlled volume instead of a clump or an all-at-once release of the pills. The main purpose of the terrain domes 16 on the hinged funnel 20 is to de-layer pills P when pouring the excess pills P from the counting tray 10 back into the stock bottle. The controlled delivery of pills to the stock bottle minimizes spillage, contamination and results in increased efficiency. The terrain domes 16 of the funnel surface are the same size as the terrain domes 16 of the counting surface, or 0.03 inches high and 0.13 inches in diameter, but their spacing is slightly different, as shown in FIG. 8. The terrain domes 16 are spaced in a left to right line D and are 0.28 inches apart, and are spaced front to back E at 0.25 inches apart.

The hinged funnel 20 is attached to the counting tray 10 by means of a hinge 28. Such hinges 28 are well known in the art and consist of two small tube sections mounted on the hinged funnel underside 25 and a corresponding tube section mounted on the counting tray underside 15, with a funnel hinge pin 2 mounted through the tube sections to hold the components together and to allow the components to rotate about the hinge 28. The hinged funnel 20 can rotate upward up to 90 degrees off horizontal. The rear wall 18 and back wall 22 form a straight line. In order to allow the hinged funnel 20 to rotate, there is a gap 29 in the back wall 22. The hinged funnel 20 is made of molded plastic, and the gap 28 in the back wall 22 is a groove into the back wall 22. The back wall 22 is also beveled away from the funnel surface 21 at this point as seen in FIG. 3. The rear wall 18 has a wall extension 19, which is an angled flange that protrudes slightly from the rear wall 18, and inserts into the gap 28. This ensures that the rear wall 18 and back wall 22 are a continuous wall to prevent pills P from falling off of the pill counting tray 100.

Figure 9A:
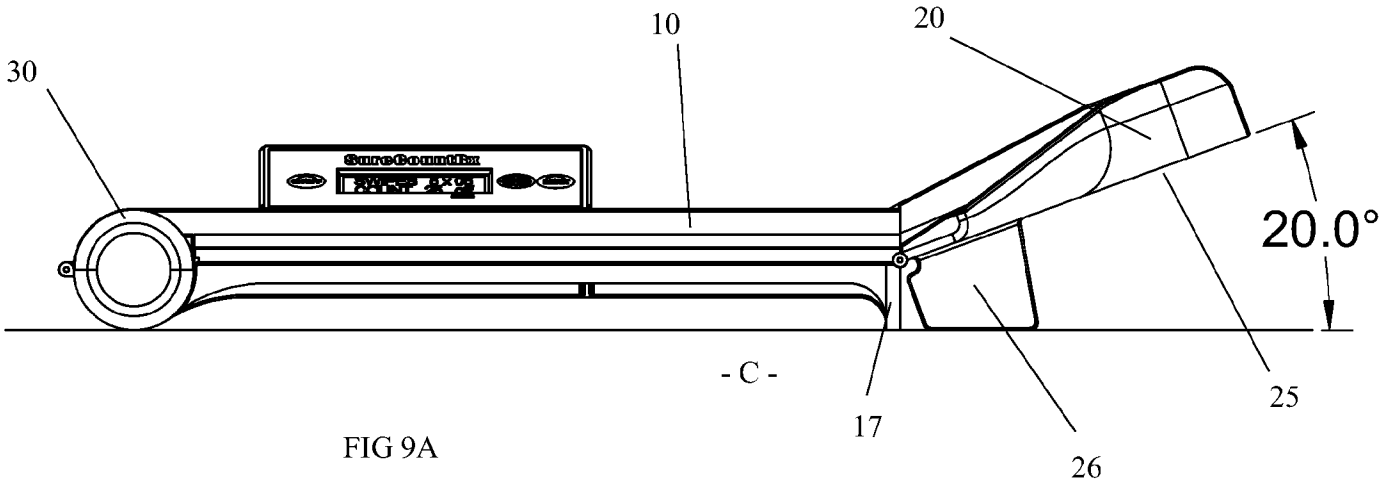
FIG. 9A is a side plan view showing the invention when setting on a table top with the hinged funnel raised.

The hinged funnel is configured so that when the pill counting tray 100 is setting on a counter C or other flat work surface, the hinged funnel 20 is raised. This is shown in FIG. 9A. In the preferred embodiment the hinged funnel 20 sits at a twenty degree angle above vertical. This creates a back stop that prevents pills P from pouring off the counting surface 11 and out of the return spout 24. In this configuration the technician will pour the pills P from a stock bottle onto the raised funnel surface 21, and they will slide down onto the return end 12 of the counting tray 10. The terrain domes 16, which are located on both the return end 12 and part of the hinged funnel 20 prevent the pills from clumping, and make them easier for the technician to separate and count them.

Figure 9B:
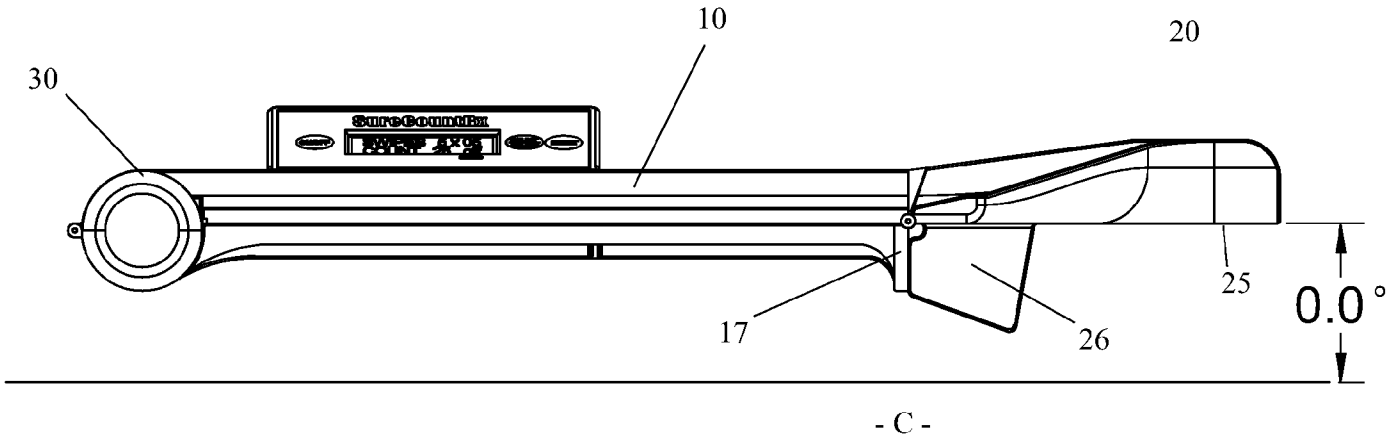
FIG. 9B is a side plan view showing the invention when raised from the table top and the hinged funnel is lowered.

The funnel pedestal 26 is attached to the funnel underside 25, as best seen in FIG. 4, FIG. 9A, & FIG. 9B. The funnel pedestal 26 is a quadrilateral flange that protrudes at 90 degrees downward from the funnel underside 25. It is approximately one inch on the sides, and extends down below the contiguous leg 17. It is sized so that when the pill counting tray 100 is placed on a flat surface C, the funnel is rotated up from the vertical, as seen in FIG. 9A. When the pill counting tray 100 is lifted up, the hinged funnel 20 will rotate about the hinge 28. The funnel pedestal 26 also prevents the hinged funnel 20 from rotating too far down when the pill counting tray 100 is lifted off a surface. There is contiguous leg 17 mounted on the tray underside 15 as seen in FIG. 4. The contiguous leg 17 protrudes perpendicularly from the tray underside 15. The funnel pedestal 26 is configured to contact the contiguous leg 17 when the pill counting tray 100 is lifted, and is configured so that when lifted the funnel surface 21 aligns flat with the tray surface 11.

There is a dispending chamber 30 located on the left side of the counting tray 10. The dispensing chamber consists of a chamber bottom 31, and a chamber cover 32. In the preferred embodiment the chamber bottom 31 is molded of the same piece of material as the counting tray 10. The chamber cover 32 is attached to the chamber bottom 31 by means of a hinge 35. The hinge 35 is of a standard and well known type, and consists of at least two small tubes mounted on the chamber bottom 31 and at least two small tubes mounted on the chamber cover 32 such that the interior bore of the tubes align, and a chamber pin 3 that is securely inserted into the tubes to create a hinge. The chamber cover 32 rotates about the hinge 35 to cover the chamber bottom 31. When closed, the chamber cover 32 and chamber bottom 31 create the dispensing chamber 30, which is a hollow cylindrical tube designed for holding the counted pills P, and then dispensing them into the patient's pill bottle. Both the chamber bottom 31 and chamber cover 32 have beveled ends to create a dispensing spout 33. There is a closed end 37 on the opposite end of the dispensing chamber 30 from the dispensing spout 33. The closed end 37 prevents the pills P in the dispensing chamber 30 from pouring out when the tray 100 is lifted and tilted to pour the excess pills P into the stock bottle. The dispensing chamber spout 33 is sized to fit easily into a pill bottle or medicine bottle, which allows the pills from the dispensing chamber 30 to be easily poured into the patient's pill bottle.

In standard use, the pill counting tray 100 is placed on a counter top C, or other flat surface. In this configuration the funnel pedestal 26 contacts the counter top C and forces the hinged funnel 20 to rotate upward so that the hinged funnel 20 is raised at a 20 degree angle to create a backstop to prevent pills P from spilling out of the hinged funnel 20. Typically the chamber cover 32 will be closed over the chamber bottom 31 to prevent pills P from inadvertently entering the chamber bottom 32. The technician who is dispensing the prescription medicine will pour pills P from the stock bottle onto the pill counting tray 100. The beveled configuration of the hinged funnel 20 will allow the technician to pour pills P onto the hinged funnel surface 21, and the terrain domes 16 on the funnel surface 21 and the return side 12 of the counting tray 10 will help disperse the pills P in a relatively even manner, and will also prevent the pills P from clumping or clustering, or for one pill to lay on top of other pills. Most pills P are small and hard, and often bounce around when being poured from the stock bottle. The raised hinged funnel 20 prevents pills P from bouncing out of the spout 24, and the rear wall 18 and back wall 22 prevent pills from spilling off the back of the counting tray 10 or hinged funnel 20. The technician will know how many pills P are to be prescribed, and will pour out a number of pills P that seems slightly more than the total number of pills P to be dispensed. Most skilled technicians can estimate fairly accurately. Once the pills P are dispersed on the counting tray 10, the technician will open the chamber cover 32, and use a wand 70 to count the pills and slide them into the chamber bottom 31. Such wands 70 are common and well known in the pharmaceutical industry. The wand 70 resembles a small flat knife, much like a butter knife, and is often called a spatula or a counting stick. Sliding the counted pills P across the counting surface 11 with the wand 70 is often referred to as a "swipe" of the wand 70. Technicians typically count by two's or five's, and use the wand 70 to swipe the counted pills into the dispensing chamber 30. As used herein, the term "count" is used as a verb to denote the process of counting the pills P into the dispensing chamber 30 by means of the wand 70. Once the correct number of pills P have been counted and placed in the dispensing chamber 30 the chamber cover 32 is closed.

There will be a number of excess pills P on the counting tray 10. These pills P need to be returned to the stock bottle. The technician does this by lifting the pill counting tray 100. This will allow the hinged funnel 20 to rotate downward so that the funnel surface 21 is now flat with the counting surface 11. The technician will also rotate the pill counting tray 100 downward and away so that the rear wall 18 is lower than the front edge 14, which will allow the excess pills P to roll or slide against the rear wall 18 and the top wall 22. The technician will then place the stock bottle on the counter next to the funnel spout 24. The technician will then align the funnel spout 24 so that it is aligned with the mouth of the stock bottle. The technician will then turn the pill counting tray 100 slightly, lowering the funnel spout 24, and the pills P should slide and roll from the counting surface 11 across the funnel surface 21, down and through the funnel spout 24, and into the stock bottle. The configuration of the rear wall 18 in a straight line with the top wall 22 allows the technician to only have to twist the tray 100 slightly, and allows the pills P to flow easily. The relative height of the top wall 22 and the side wall 23 will prevent the pills P from spilling off the hinged funnel, and the terrain domes 16 will keep the pills P flowing smoothly. The terrain domes 16 also help prevent clumping and potential overflow which can lead to possible contamination when pouring pills P back into the stock bottle. The pills P to be dispensed will remain secure within the dispensing chamber 30 because the dispensing spout 33 is located on the opposite side of the pill counting tray 100 from the return spout 24, such that when the pill counting tray 100 is tilted toward the funnel return spout 24 the dispensing chamber 30 is rotated toward the closed end 37 to keep the pills within the dispensing chamber 30. Once all of the excess pills have been poured from the hinged funnel 20 return spout 24 into the stock bottle, the technician can pour the prescribed pills P from the dispensing chamber 30 into the patient's medicine bottle. This is done by placing the medicine bottle over the dispensing spout 33, and rotating the pill counting tray 100 to pour the pills from the dispensing chamber 30 into the medicine bottle.

The pill counting tray 100 includes a Programmable Digital Counting System (PDCS) 40 which includes sensing technology, as described below. In an overview of the preferred embodiment the PDCS uses magnetic sensors and a magnet to signal the digital counting of wand swipes, registering that pills are entering the dispensing chamber 30. The main components of the PDCS 40 include the digital counter 50, the visible display 41, the sensor 51 and the wand 70. The sensor 51 is configured to sense the movement of the wand 70, and provides this movement information to the digital counter 50, which displays the count on the visible display 41. In the preferred embodiment the sensor 51 is connected to the digital counter 50 by means of a wiring harness 54, which internally contains power and sensor wires. The digital counter 50 and visible display 41 are combined in one electronic component, with the digital counter 50 the internal computer component, and the visible display 41 displaying the information compiled by the digital counter 50. In the preferred embodiment the sensor 51 is mounted on the underside 15 of the tray 10 roughly half way between the front edge 14 and the rear wall 18, and roughly one inch from, or nearly adjacent to, the dispensing chamber 30, as shown in FIG. 2.

Figure 10:
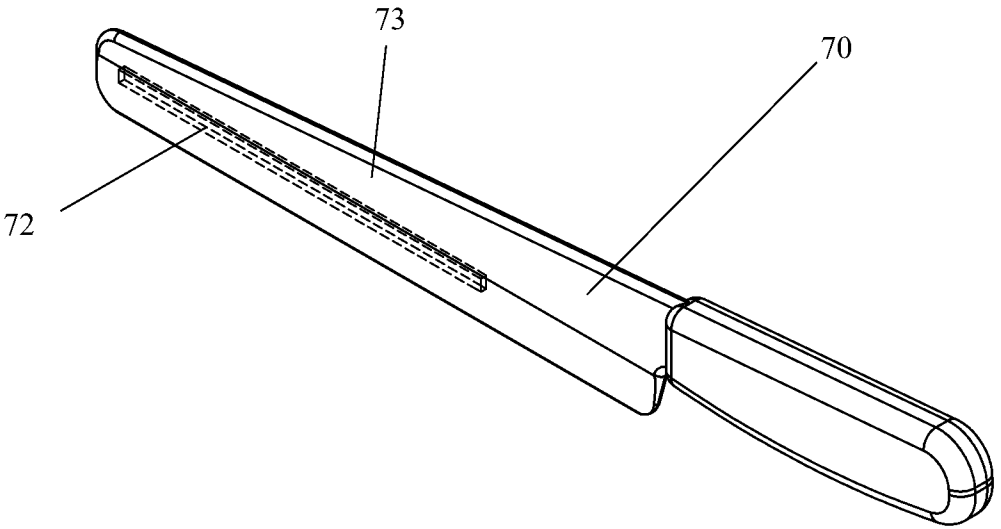
FIG. 10 is a perspective view of the wand.

Referring now to FIG. 10, the wand 70 incorporates sensor receptive material, or material that is specifically designed to be sensed by the accompanying sensors as described below. In the preferred embodiment the wand 70 is magnetized by in the incorporation of a strip magnet 72 placed on or within the blade 73 of the wand 70. The wand 70 is made of molded plastic. In one embodiment the magnet 72 is glued onto the blade 73, in an alternate embodiment the blade 73 is molded with an internal space for the magnet 72. The magnet 72 can be any kind of appropriately sized magnet, but in the preferred embodiment it is a grade N42 neodynium magnet. Neodynium magnets are common and well known. The higher the N rating the stronger the magnet, and an N42 is one of the stronger magnets of this type. In the preferred embodiment the magnet is a N42 magnet in a strip that is 1 inch long, one-eight (1/8) inch wide, and one-sixteenth (1/16) inch thick. The actual size of the magnet 72 can vary based on the size of the wand 70. It is also possible that a smaller but stronger magnet could be used, or a larger but weaker magnet. In the preferred embodiment the blade 73 has a recessed groove the size of magnet 72, and the magnet is snuggly inserted into the recessed groove. The magnet 72 can also be glued into the groove for additional retention strength. It is also possible for the magnet 72 to be glued directly to the blade 73. The magnet 72 is in the blade 73 of the wand 70 because that is the part that is used to swipe the pills P when counting, so that is the part that will come closest to the sensor 51. The sensor 51 is sensitized to a magnetic field, as described below, and registers the proximity of the magnetic field. This allows the sensor 51 to register each swipe of the wand 70 as it moves from the counting tray 10 to the dispensing chamber 30. It is possible, and within the conception of the invention to use a standard metal spatula as the wand 70, and to magnetize the metal in the conventional manner.

In the preferred embodiment the sensor 51 internally contains two Hall Effect Sensors, a first HE sensor 51*a*, and a second HE sensor 51*b* (not shown). Hall Effect Sensors are standard sensor for detecting the presence of a magnetic field. A Hall Effect Sensor consists of a transducer that varies a voltage output in response to a magnetic field, and such sensor are well known and commonly used for proximity switching, position, and speed detection. The Hall Effect Sensor detects the presence of a magnetic field and generates a digital signal. In the preferred embodiment Allegro MicroSystems, p/n A3211ELHLT-T Hall Effect Sensors are used, but these types of sensors are well known, and any suitable sensor can be used. The sensor 51 is in electronic communication with the digital counter 50. In the preferred embodiment the sensor 51 is connected to the digital counter 50 by means of a cable 54. The cable 54 is a bundle of four wires, two power wires one to power each Hall Effect Sensor 51*a* and 51*b*, and two sensor signal wires, one for each Hall Effect Sensor 51*a* and 51*b* to send the signal information from the sensor 51 to the digital counter 50.

The digital counter 50 counts the swipes of the wand 70 based on the signal from the sensor 51. The digital counter 50 consists of a standard printed circuit board with a number of integrated components, including an 8-bit microcontroller chip that receives and processes the signal from the sensor 51 based on internal firmware, a rechargeable Li-ion battery for power, a MOSFET transistor for switching electronic signals, a USB connector, a LED to indicate power, a Piezo beeper for emitting an audible signal, and appropriate capacitors and resistors for proper operation. Such integrated circuit boards are common and well known, and all components are standard off the shelf components. The microcontroller is programmed to respond to the sensor signal and to control signals from the control buttons as described below. The microcontroller is also programmed with the relevant math operations to compute the appropriate information. In the preferred embodiment the microcontroller is a PIC 16F627 8-bit CMOS microcontroller. Such small microcontrollers are application specific computer chips designed specifically for controlling, and are well known in the art and can be programmed to perform a wide variety of tasks. The counting of wand 70 swipes and the multiplication of swipes times pill count iteration or number (as described below) is a very simple and easily programmed task for this type of microcontroller. The microcontroller is connected to a standard liquid crystal display, which is the visual display 41 as described below. In the preferred embodiment the liquid crystal display is a Electronic Assembly EA DOGM 162 LCD, but there are many common small LCD's that would operate appropriately.

The movement of the wand 70 from right to left over the sensor 51 triggers the first sensor 51*a*, which then activates the second sensor 51*b*. When the wand 70 passes the second sensor 51*b* in a right to left motion, it reads a swipe and relays the information of a single swipe to the digital counter 50. When the wand 70 moves backwards (left to right), the internal firmware in the microcontroller is preset to not record this as a swipe. It is important for the magnet 72 to be appropriately sized for the sensor 51. If the magnet 72 is too powerful, the sensor 51 will often double count the presence of the magnet 72, and if the magnet is too weak, the sensor 51 may not pick up every swipe. The power of a magnet is a product of its size and magnetic pull force. As noted above, the optimal size of the magnet 72 used in the preferred embodiment is 1 inch long, $1/8^{th}$ inch wide, and 1/16 inch thick. The preferred magnet is a neodymium iron boron magnet, which are common magnets used in a wide variety of commercial uses, and has a grade of N42.

It is common for technicians to count pills in 2's or 5's, and the digital counter 50 includes control buttons to allow the technician to input the desired swipe pill count number. For example if the technician counts by two's, the count of two will be entered into the digital counter 50. Then, as the technician swipes pills P into the dispensing chamber the sensor 51 will count the number of swipes, and the digital counter 50 will automatically multiply the number of swipes times the pills per swipe and display the total number of pills on the visible display 41.

In the preferred embodiment there is a PDCS housing 52 which is sized to hold the digital counter 50 and the visible display 41. In the preferred embodiment, the PDCS housing is attached to the top left of the counting tray 10. In the preferred embodiment the PDCS housing 52 is molded from the same material as the counting tray 10 and forms a single piece, but it is also possible for the PDCS housing 52 to be attached in any conventional manner including by screws or adhesive glue. The PDCS housing 52 includes a number of openings to correspond to the control buttons of the digital counter 50. There is a large window for the visible display 41, and small holes to allow access to the on/off switch 46, the increment change button 47, and the reset count button 48. The digital counter 50 is placed inside the PDCS housing 52 and attached, conventionally by means of screws. As best seen in the exploded views of FIG. 3 & FIG. 4, there is a housing cover 53 that is placed across the back of the PDCS housing 52 and attached to secure the digital counter 50 in place. A membrane overlay 60 is placed onto the exterior surface of the PDCS housing 52. The membrane overlay 60 is embossed or preprinted with button information to correspond to the control buttons of the digital counter 50. There is a preprinted on/off switch tab 66 that is positioned over the on/off switch 46, a preprinted increment change tab 67 that is positioned over the increment change button 47, and a reset count tab 68 that is positioned over the reset count button 48.

Figure 11:
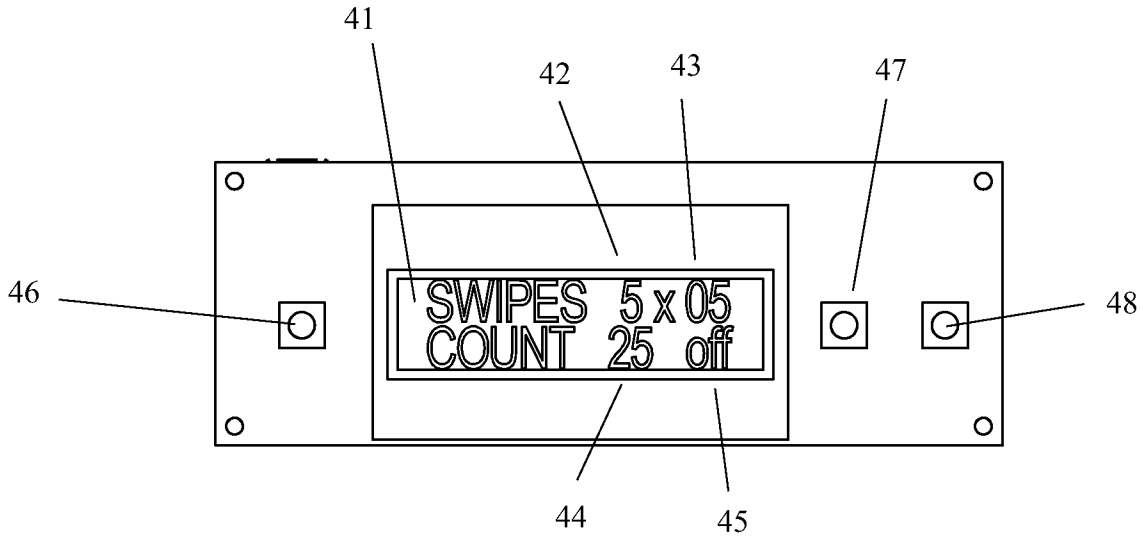
FIG. 11 is a top plan view of the digital counter and visible display.

As seen in FIG. 11, the digital counter 50 has an on/off button 46 to turn the counter on and off. It has a reset count button 48 to set the count back to zero to start the count over again. The digital counter has an increment change button 47 that allows the user to set the increments, or number of pills in each swipe. The user sets the increments by briefly pressing the increment change button 47 one or more times to reach the desired number of pills P per swipe. The increment change button 47 is coupled in one embodiment with an on/off switch for an audio beep function, which provides an audible beep to note each swipe. When the incremental count button 47 is held down for a period of a few seconds, it activates the audio function and turns the audio function on or off.

The PDCS 40 includes a visible display 41 that shows the number of swipes and pills that are inside the dispensing chamber. As seen in FIG. 11, the visible display 41 shows the number of swipes display 42, the incremental pill count display 43, the cumulative count total display 44, and the sound setting display 45 for the audible notification. The incremental pill count number is set by the user by means of the incremental count button 47. The user turns on the digital counter 50 by means of the on/off switch 46, which is shown on the membrane overlay 60 as the on/off switch 66, and in one embodiment marked "On/Off." When the digital counter 50 powers up, the visible display 41 will illuminate. If the cumulative count total display 44 is not zero, the user can press the reset count button 48, or 68 on the membrane. This will return the cumulative count total display 44 to zero. The user can then select the desired incremental pill count number by depressing the incremental count button 47, or 67 on the membrane, the desired number of times to correspond to the desired number of pills per swipe. The incremental count number will show up on the incremental pill count display 43. The system is now ready to use, and as the user swipes pills across the sensor 50 the number of swipes display 42 will show the number of swipes of the wand 70. The digital counter 50 will automatically calculate the total number of pills based on the incremental pill count number, and will display a running total of the number of pills on the cumulative count total display 44. The PDCS 40 maintains an accurate count of the pills that are added to the dispensing chamber 30. If an employee has to pause or address someone away from the tray, the count is stored and remains active until the individual's return. Upon returning, they pick up where they left off and resume the count. When they are finished, they simply dispense the current quantity of pills and hit reset button to start counting the next prescription.

The PDCS 40 includes a sound producing device. It can be a bell or piezoelectric buzzer or instrument or automated sound or voice transmitted through a speaker. Such sound producing devices are common and well known with small computerized equipment, and typically include a small speaker located within the device. In the preferred embodiment, the sound producing device makes an audible beep when a swipe of the wand 70 is registered with the digital counter 50. This feature may be turned on or off by the user. In other embodiments, the tray may vibrate to signal a swipe, or it may flash a light or change colors, or display a new message. In other embodiments, a computerized voice may audibly count with the user as they swipe the wand 70. Instead of a beep each time, the programmed voice would utter "five, ten, fifteen" and essentially counting with the user. In other versions, there may be headphones for users to hear the device's messages but not interrupt or interfere with the other workers at the business. All are features that are easily achieved with standard, off the shelf, digital electronics. It is possible, and within the conception of the invention to connect the PDCS 40 to a computer by means of a USB cable, which will allow daily, monthly, or hourly reports of the dispersion of medicine. The report would detail the number of pills counted per hour and the user's average speed. It is possible, and within the conception of the invention for the PDCS 40 to incorporate a bar code scanner which will allow the scan of a prescription barcode and links drugs to a drug database and links them to the pharmacy patient database and software. The PDCS 40 may save that data to itself or an external device or send it wirelessly (via wifi, bluetooth, cell tower network) to a computer for another individual to monitor. The external device may be programmed to recognize pills and alert the user if a different pill is on the tray than the rest, and the device may change the volume or the audible beep or count to indicate the presence of a different type of pill. These audible and advanced features may not totally eliminate theft or employee lethargy, but it makes employees more accountable than ever before in weight, laser, or antique hand counting methods.

The PDCS 40 can be powered by standard batteries typical of such small electronic components. In the preferred embodiment the PDCS 40 is powered by rechargeable batteries that can be recharged through a USB adapter. It is also possible for the PDCS 40 to be powered by a standard 120 volt wall plug adapter.

In alternate embodiments the PDCS 40 can incorporate an audio receiver so that the digital counter 50 may be triggered by an audible sound or verbal statements, such as the technician saying a word or tapping the wand 70. In another embodiment, the user can manually trigger each swipe through a button placed on the wand 70. It can be triggered by the operator externally to the device or through a button on the device.

In operation the PDCS 40 allows the user to count pills P by increments from one to ten, though as noted one, two, and five are the most common. The PDCS 40 saves the increment count in its settings memory. Once the user sets the pill increment count with the increment change button 47, the user may commence counting by swiping pills P into the dispensing chamber 30. As the wand 70 passes across the sensor 51 the PDCS 40 records the swipe, the microprocessor of the digital counter 50 does the mathematical calculations, and displays the running total pill count on the visible display 41. The pill counting tray 100 with PDCS 40 allows a user to count as high as necessary for any amount of pills P. When the prescribed pill count is reached the user will close the chamber cover 32, lift the pill counting tray 100, which will allow the hinged funnel 20 to rotate and set the funnel surface 21 level with the counting surface 11. The user can then tilt the pill counting tray 100 backward slightly, which will allow the excess pills P to roll or slide against the rear wall 18 and back wall 22. Then, by tilting the pill counting tray 100 slightly to lower the spout 24, the excess pills P can easily be poured into a stock bottle. Once the excess pills P are off the pill counting tray 100, the user can pour the prescribed pills P from the dispensing chamber 30 into the patient's pill bottle.

It is possible, and within the conception of the invention for the PDCS 40 to use a laser sensor, a vibration or tactile sensors, a weight sensor, or other common forms of mechanical sensors of any kind. It is also possible, and within the conception of the invention, to use a motion sensor or wrist sensor that monitors the user's hand or wrist movement. It is possible, and within the conception of the invention, for the sensor 51 to be in the wand 70, and the sensitive material (such as the magnet 72 of the preferred invention) to be located on the counting tray 10 near the dispensing chamber 30. In the preferred embodiment the PDCS 40 is mounted on the pill counting tray 100. This is for convenience sake and is not an important component of the invention. Therefore it is possible, and within the conception of the invention, for the PDCS 40 to be attached to the pill counting tray 100 at different locations, or be separate from the pill counting tray 100 entirely. It may be a stand alone component, which is set near the pill counting tray 100 during use. It is also possible, and within the conception of the invention, for the sensor signal to be sent directly to an external computer such as a laptop or tabled device to record the swipe count information.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only be the spirit and scope of the claims, giving full cognizance to equivalents in all respects.

We claim:

1. A pill counting tray for counting and dispensing medication in pill form, said pill counting tray consisting of:

a counting tray having a substantially flat counting surface for counting pills, a front edge, a rear wall, and an underside; said counting surface having a dispensing side and a return side;

a dispensing chamber attached to said counting tray at said dispensing side such that counted pills are placed in said dispensing chamber for transfer to a patient's medicine bottle;

a return funnel attached to said counting tray at said return side, said return funnel having a top surface, a top wall, a side wall that angles toward said top wall to create a spout, and an underside; wherein said return funnel is configured for removing excess pills from said counting tray;

wherein said return funnel is attached to said counting tray by means of a hinge, and wherein said return funnel includes a funnel pedestal attached to said return funnel underside such that when said pill counting tray and return funnel are positioned on a horizontally flat surface said return funnel is tilted upward at an angle above said flat counting surface to create an angled back stop to prevent the pills from flowing off said return funnel;

a pill counting wand for separating, moving and counting said pills;

wherein pills are poured onto said counting surface and counted into said dispensing chamber with said wand.

2. The pill counting tray of claim 1, further comprising;

a contiguous leg attached to said counting tray underside;

wherein when said pill counting tray and return funnel are lifted from said flat surface said return funnel rotates downward about said hinge, and wherein said contiguous leg provides a stop for said pedestal and said pedestal is configured to engage said contiguous leg such that the surface of said return funnel is flat with said counting surface; whereby any excess pills on said counting surface can easily slide off said counting surface and through said funnel into a stock bottle.

3. The pill counting tray of claim 1, wherein said rear wall has a first height, and said top wall and side wall has a second height taller than said first height to prevent excess pills from flowing off said funnel when being poured into the stock bottle.

4. The pill counting tray of claim 1 wherein said top wall intersects said rear wall such that said top wall is in a straight line with said rear wall to allow the pills to flow in a straight line for the easy pouring of said excess pills into said stock bottle.

5. The pill counting tray of claim 1 further comprising;

a multiplicity of terrain domes disposed on said return side of said counting surface; wherein said terrain domes prevent the pills from clumping and clustering on said counting surface.

6. The pill counting tray of claim 5, wherein said terrain domes are evenly spaced in a grid pattern.

7. The pill counting tray of claim 5 wherein said terrain domes have a height of between 0.01 and 0.1 inches, and are circular with a diameter of between 0.05 and 0.20 inches.

8. The pill counting tray of claim 1 further comprising;

a multiplicity of terrain domes disposed on said top surface of said return funnel; wherein said terrain domes prevent the pills from clumping and clustering on the funnel top surface.

9. The pill counting tray of claim 8, wherein said terrain domes are evenly spaced in a grid pattern.

10. The pill counting tray of claim 1 ; further comprising;

a multiplicity of terrain domes disposed on said return side of said counting surface; wherein said terrain domes prevent the pills from clumping and clustering on said counting surface.

11. The pill counting tray of claim 10 wherein said return side consists of one third of said counting surface.

12. The pill counting tray of claim 10 further comprising;

a multiplicity of terrain domes disposed on said top surface of said return funnel; wherein when pills are poured from a stock bottle onto said terrain domes of said raised return funnel and said terrain domes of said counting surface, and said terrain domes prevent the pills from clumping and clustering.

13. The pill counting tray of claim 1, further comprising a means for digitally counting the pills which consists of;

a pill counting wand incorporating a sensor receptive material;

a sensor disposed on said underside of said counting tray adjacent said dispensing chamber, said sensor configured to sense the sensor receptive material on said wand to sense a swipe movement of said pill counting wand across said sensor, and said sensor providing e a movement output based on said swipe movement;

a digital counter having a visible display, said digital counter in electronic communication with said sensor to receive said swipe movement output; wherein said digital counter records the swipe movement of said wand based on said movement output, and said visible display displays swipe movement information.

14. The pill counting tray of claim 13 wherein said digital counter incorporates an internal programmable computer, wherein said internal programmable computer can be programmed with a pill count increment, said pill count increment based on the number of pills counted per swipe movement, and where said internal computer will calculate the number of swipes times the pill count increment to produce a running total pill count; and wherein said visual display displays the pill count increment, the number of swipes, and the running total pill count.

15. The pill counting tray of claim 13 where said sensor receptive material consists of a magnet.

16. The pill counting tray of claim 13 further including a sound producing device integrated within said digital counter to produce an audible signal based on said swipe movement output.

* * * * *